US007258235B2

(12) United States Patent
Liu et al.

(10) Patent No.: US 7,258,235 B2
(45) Date of Patent: Aug. 21, 2007

(54) FIBERBOARD CARTON WITH SECURED DIE CUT INSERT

(75) Inventors: An-Hsia Liu, 1468 W. 178th St., Gardena, CA (US) 90248; Victor D. Liu, Gardena, CA (US); Alexander D. Liu, Gardena, CA (US)

(73) Assignee: An-Hsia Liu, Toraance, CA (US)

( * ) Notice: Subject to any disclaimer, the term of this patent is extended or adjusted under 35 U.S.C. 154(b) by 239 days.

(21) Appl. No.: 11/016,344

(22) Filed: Dec. 17, 2004

(65) Prior Publication Data

US 2006/0042983 A1 Mar. 2, 2006

Related U.S. Application Data

(60) Provisional application No. 60/606,375, filed on Aug. 31, 2004.

(51) Int. Cl.
*B65D 81/02* (2006.01)

(52) U.S. Cl. ..... 206/590; 206/586; 206/591

(58) Field of Classification Search ..... 206/588–594, 206/418, 346

See application file for complete search history.

(56) References Cited

U.S. PATENT DOCUMENTS

| | | | | | |
|---|---|---|---|---|---|
| 2,367,345 | A | * | 1/1945 | Fischer | 206/418 |
| 2,422,152 | A | * | 6/1947 | Vatter | 206/418 |
| 2,768,737 | A | * | 10/1956 | Callahan | 206/418 |
| 2,787,862 | A | * | 4/1957 | Hoeflich | 446/71 |
| 2,827,219 | A | * | 3/1958 | Sparks | 206/588 |
| 4,832,190 | A | * | 5/1989 | Favreau | 206/320 |
| 5,358,116 | A | * | 10/1994 | Brintazzoli | 206/485 |
| 5,813,523 | A | * | 9/1998 | Gnadt et al. | 206/77.1 |

* cited by examiner

*Primary Examiner*—Jila M. Mohandesi

(57) ABSTRACT

A package arrangement for storing a container includes a carton having a receiving cavity, and a die cut insert. The die cut insert is detachably disposed in the receiving cavity of the carton, and includes a top panel having at least a top panel cavity and a bottom panel having at least a bottom panel cavity aligned with the top panel cavity of the top panel, wherein the die cut insert is adapted for substantially retaining the container in the carton when the container is slidably inserted into the die cut insert through the top panel cavity and the bottom panel cavity at a position that an upper portion of the container is encircling supported by the top panel and a lower portion of the container is encircling supported by the bottom panel.

32 Claims, 13 Drawing Sheets

FIBERBOARD CARTON WITH SECURED DIE CUT INSERT

CROSS REFERENCE OF RELATED APPLICATION

This application is a regular application of a provisional application, having an application No. 60/606,375 and a filing data of Aug. 31, 2004.

BACKGROUND OF THE PRESENT INVENTION

1. Field of Invention

The present invention relates to a packaging, and more particularly to a package arrangement in which a die cut insert is fittedly disposed in a fiberboard carton for substantially and securely supporting a container within that carton.

2. Description of Related Arts

Cartons have widely been used for transportation of industrial products. As a matter of conventional practices, a particular kind of goods is first contained in a specifically-designed holder. That holder, with the goods contained therein, is ultimately packed into the cartons for transportation. The primary reason for utilizing the specifically-designed holder is to avoid unwanted movement of the goods inside the carton during transportation, thus minimizing unwanted damages of the goods upon arriving to the receiving side.

Under this particular background, there exists a pressing problem for transporting goods contained in a substantially cylindrical and fragile container, such as glass wine bottles, because it is rather difficult to constraint movements of cylindrical container inside the carton.

One way of doing that is to give up fiberboard carton altogether and utilize a styrofoam rack having a plurality of storage compartments for receiving the cylindrical containers. While styrofoam racks generally achieve satisfactory performance in reducing unwanted damages of the containers, they inevitably increase the logistic cost and the ultimate selling price of the relevant goods.

Moreover, the use of plastic racks is definitely not environmentally friendly because the papers used for making the fiberboard cartons can usually be recycled, whereas it is more difficult to deal with the used styrofoam racks.

SUMMARY OF THE PRESENT INVENTION

A main object of the present invention is to provide a package arrangement for a container, wherein the package arrangement is capable of withstanding unwanted impact directed towards the container, and resisting unwanted movement of the container within a carton during transportation.

Another object of the present invention is to provide a package arrangement in which a die cut insert is detachably disposed in a carton for substantially and securely supporting a container within that carton, so as to prevent unwanted damage of the container.

Another object of the present invention is to provide a package arrangement comprising a die cut insert which can be manufactured by folding a piece of fiberboard in a predetermined manner so as to minimize a manufacturing cost and procedure of the die cut insert. In other words, the fiberboards can be overlappedly stacked up for minimizing the storage space and for transportation while the fiberboard is folded to form the die cut insert at the time for packaging the container.

Accordingly, in order to accomplish the above objects, the present invention provides a package arrangement for storing a container, comprising:

a carton having a receiving cavity; and a die cut insert, which is detachably disposed in the receiving cavity of the carton, comprising:

an top panel having at least a first through retention cavity; and a bottom panel having at least a bottom panel cavity coaxially aligned with the top panel cavity of the top panel, wherein the die cut insert is adapted for substantially retaining the container in the carton when the container is slidably inserted into the die cut insert through the top panel cavity and the bottom panel cavity at a position that an upper portion of the container is encircling supported by the top panel and a lower portion of the container is encircling supported by the bottom panel, such that the die cut insert is adapted for absorbing an unwanted impact to the container so as to prevent the container from being damaged by the unwanted impact on the container.

These and other objectives, features, and advantages of the present invention will become apparent from the following detailed description, the accompanying drawings, and the appended claims.

DETAILED DESCRIPTION OF THE PREFERRED EMBODIMENT

Figure 1:
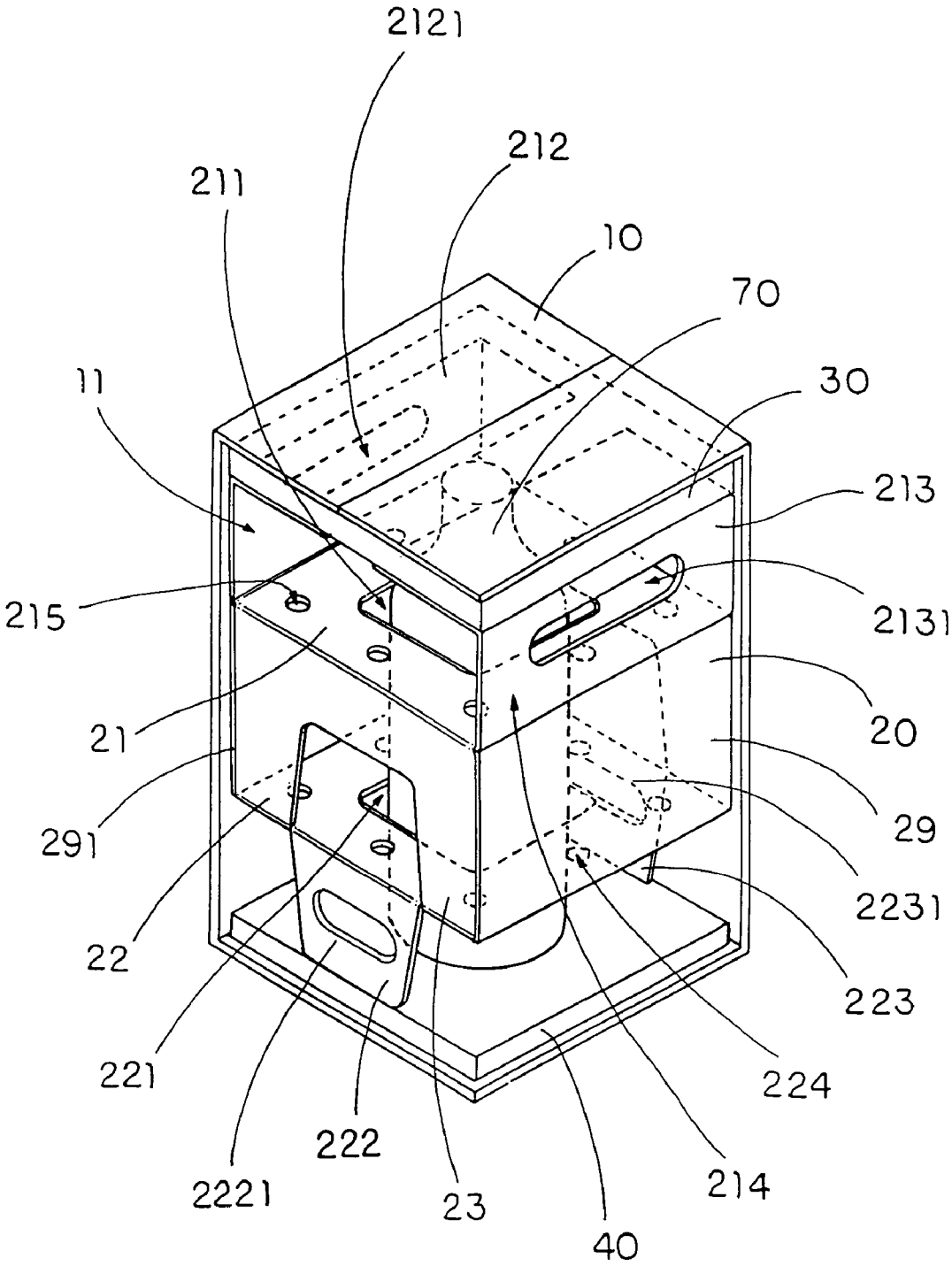
FIG. 1 is a perspective view of a package arrangement according to a preferred embodiment of the present invention.

Referring to FIG. 1 of the drawings, a package arrangement for storing a container 70 according to a preferred embodiment of the present invention is illustrated, in which the package arrangement comprises means for enclosing and protecting, means for absorbing top impact, means for protecting and guiding, means for absorbing bottom impact, and means for holding liquid.

The means for enclosing and protecting is a rigid enclosure to engage the means for protecting and guiding very closely. Accordingly, the means for enclosing and protecting comprises a carton 10 having a receiving cavity 11. The carton 10 is preferably made from a flat sheet of rigid single or multiple layer fiber board which was scored, slotted, and glued together. This carton usually has four means for top enclosing and four means for bottom enclosing together with four means for protecting and enclosing board carton walls horizontally and vertically enclose the means for protecting and guiding with means for absorbing top impact, means for absorbing bottom impact with the bottles or cans secured in it.

The means for protecting and guiding is preferably made of rigid materials such as a single or multiple layer or corrugated plastic board which was die-cut through a steel rule die, it was scored with folding lines, punched with coaxial cavities, and folded to form four sided vertical walls with the means for top and bottom protecting and guiding and framing spaced apart horizontally. Four vertical walls engage the inner walls of the means for protecting and enclosing very securely so that the movement in between is eliminated.

According to the preferred embodiment of the present invention, the means for protecting and guiding comprises means for top protecting, guiding and framing; means for bottom protecting, guiding and framing; means for upward standing, supporting and framing; means for downward standing, supporting and framing; means for adjusting and lifting; means for top positioning spacing and guiding; means for bottom positioning spacing and balancing; means for inner right side reinforcing; means for inner left side reinforcing; means for inner right side reinforcing, holding, locking; means for inner left side reinforcing, holding, locking; means for outer left side reinforcing, forming; means for outer right side reinforcing, forming; means for inserting; means for locking; means for tucking, reinforcing; means for front reinforcing holding; means for rear reinforcing, holding; means for supporting horizontally; means for supporting downward; means for cushion; holding; means for balancing the upper side impact, and means for absorbing top or bottom impact.

Specifically, the means for protecting and guiding comprises a die cut insert 20 comprising a top panel 21 having at least a top panel cavity 211, and a bottom panel 22 having at least a bottom panel cavity 221 coaxially aligned with the first through retention cavity 211 of the top panel 21, wherein the die cut insert 20 is adapted for substantially retaining the container 70 in the carton 10 when the container 70 is slidably inserted into the die cut insert 20 through the top panel cavity 211 and the bottom panel cavity 221 at a position that an upper portion of the container 70 is encircling supported by the top panel 21, and a lower portion of the container 70 is encircling supported by the bottom panel 22, such that the die cut insert 20 is adapted for absorbing an unwanted impact to the container 70 so as to prevent the container 70 from being damaged by the unwanted impact on the container 70.

Figure 2:
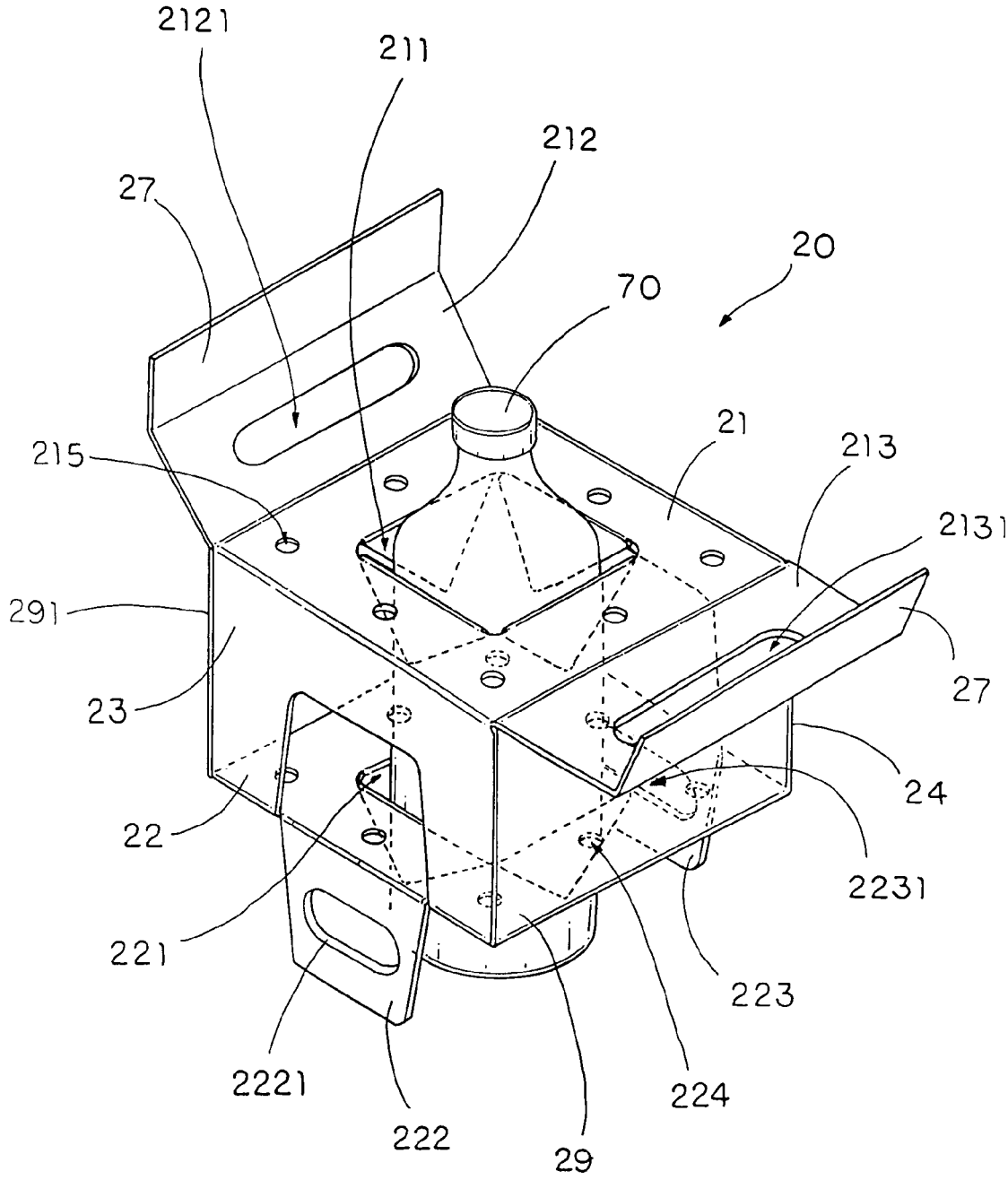
FIG. 2 is a perspective view of a die cut insert supporting a container according to the above preferred embodiment of the present invention.
Figure 3:
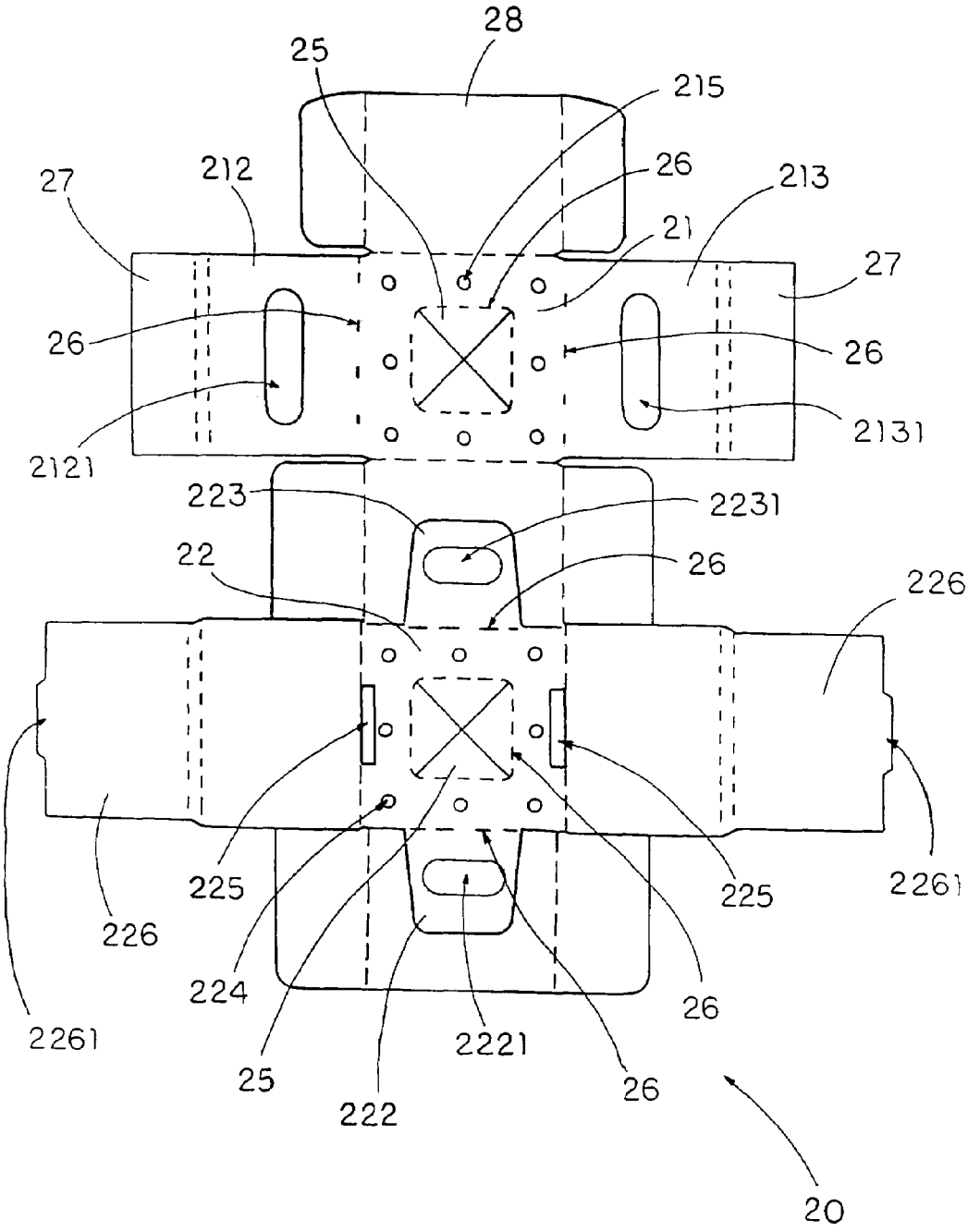
FIG. 3 is a schematic diagram of the die cut insert according to the above preferred embodiment of the present invention, illustrating that the die cut insert can be folded by a die cut fiberboard.

Referring to FIG. 1 to FIG. 3 of the drawings, the top panel 21 protects the container's upper portion. The bottom panel 22 protects the container's lower portion. Both the top panel 21 and the bottom panel 22 is die cut with single or multiple cavities, namely the top panel cavity 211 and the bottom panel cavity 221. They coaxial to each other with a predetermined distance, the center of the distance should preferably be the center gravity of the container 70.

According to the preferred embodiment, the die cut insert 20 is embodied as a box body defining the top panel 21, the bottom panel 22, a front panel 23 a rear panel 24, a right panel 29, and a left panel 291, and having a cross section fittedly corresponding with a cross section of the receiving cavity 11 of the carton 10 such that the die cut insert 20 is adapted to be detachably disposed in the receiving cavity 11.

Referring to FIG. 7A, FIG. 7B, FIG. 8A and FIG. 8B of the drawings, the die cut insert 20 is formed by a piece of fiberboard cut into a predetermined shape, wherein the fiberboard is folded to form the die cut insert having a box shape to form the top and bottom panel 21, 22, the front panel 23, the rear panel 24, and the two side panels 29, 291, such that the left and right upward flaps 212, 213 are integrally extended from the top panel 21 and the front and rear downward flaps 222, 223 are integrally extended from the bottom panel 22 for enhancing a reinforced structure of the die cut insert 20.

As a result, the portion of the top panel 21 and the bottom panel 22 between the top panel cavity 211 and the bottom panel cavity 221 to the inner walls of the carton 10 will effectively absorb the relative impact force imparted to the container 70 and also absorb the dropping impact from the ground.

The die cut insert 20 further comprises a plurality of joined flaps 25 movably extended from corresponding side edges of the top panel cavity 211 and the bottom panel cavity 221 to selectively cover the top panel cavity 211 and the bottom panel cavity 221, in such a manner that the joined flaps 25 can be folded to move downwardly or upwardly with respect to the top panel 21 and the bottom panel 22 for the container 70 to pass therethrough.

In other words, the joined flaps 25 are adapted to fold downwardly for substantially holding the container 70 when the container 70 is slidably inserted into the top and bottom panel cavities 211, 221 so as to retain the container 70 within the receiving cavity 11 in position.

Moreover, the die cut insert 20 further comprises a left upward flap 212 and a right upward flap 213 foldably extended from a top left side edge and a top right side edge of the top panel 21 for fictionally attaching against the corresponding inner walls of the carton 10 in order to prevent the inner die cut insert from moving upwardly within the receiving cavity 11 and loosing its position.

In other words, each of the left upward flap 212 and the right upward flap 213 has an outer engaging surface 214 adapted to fictionally engage with the corresponding inner walls of the carton 10 when the left upward flap 212 and the right upward flap 213 are upwardly folded to attach against the corresponding walls of the carton 10, such that a lateral upward movement between the die cur inset 20 and the carton 10 can be substantially constrained by the relevant frictional force.

In order to further retain the die cut insert 20 in position, it further comprises a front downward flap 222 and a rear downward flap 223 extended from a bottom front side edge and a rear bottom side edge of the bottom panel 22 in a foldably movable manner for being foldably moved to fictionally attach against the corresponding inner walls of the carton 10, and to stand in the carton 10, in order to prevent the die cut insert from moving downwardly within the receiving cavity 11 and loosing its position. According to the preferred embodiment, the front and the rear downward flaps 222, 223 were hinged type cut out from the front and rear panel 23, 24 of the inner die cut insert.

Figure 4:
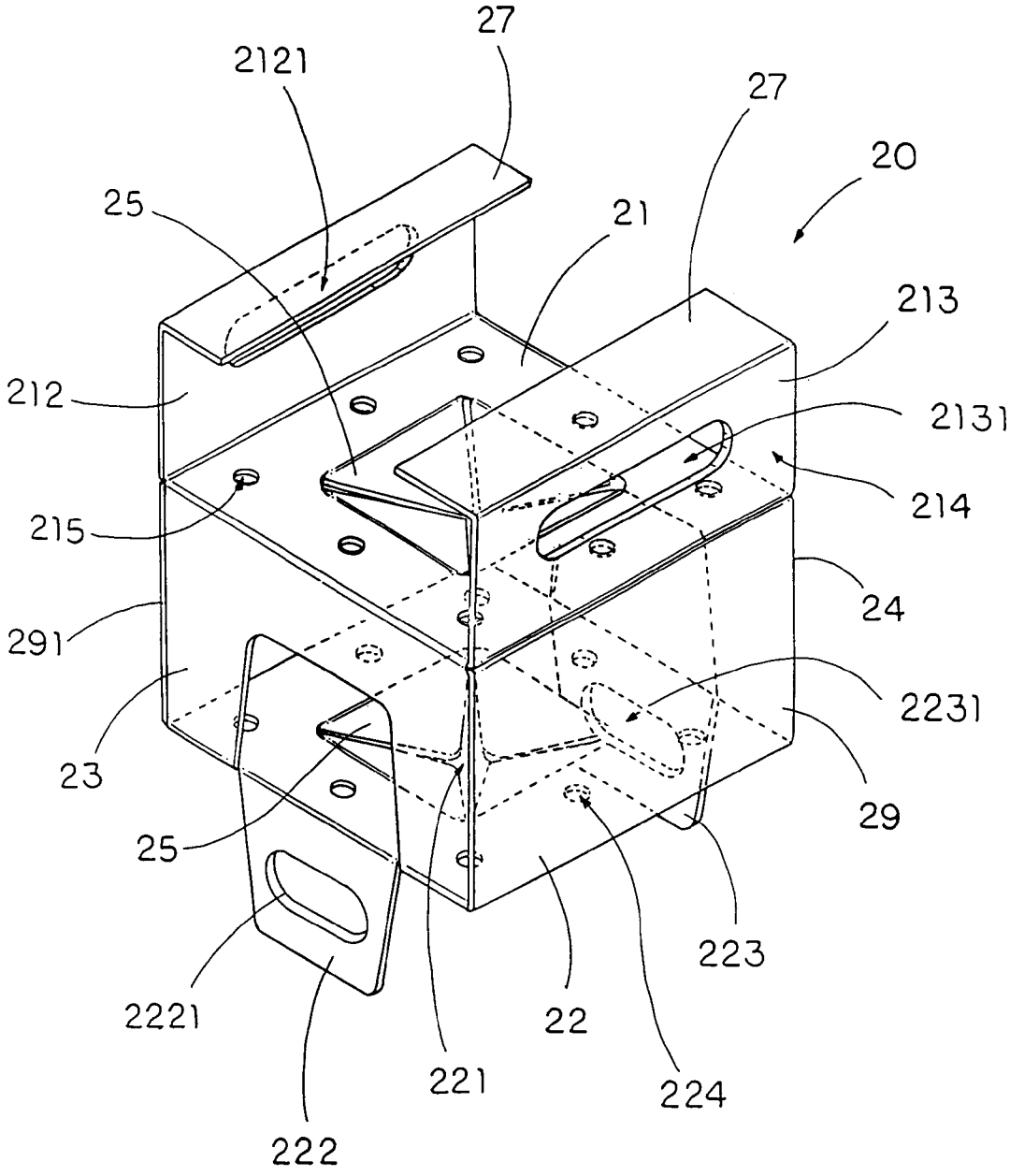
FIG. 4 is a perspective view of the die cut insert according to the above preferred embodiment of the present invention.

Referring to FIG. 2 and FIG. 4 of the drawings, the left upward flap 212 and the right upward flap 213 have first and a second hand hole 2121, 2131 formed thereon respectively to define two upper die cut handles for a user to adjust the position and to pull up the die cut insert 20 out from the container 10.

Moreover, the front downward flap 222 and the rear downward flap 223 have first and second hinge hole 2221, 2231 formed thereon to define two lower die cut handles for the user to pull the front downward flap 222 and the rear downward flap 223 for slidably adjusting a position of the die cut insert 20 within the carton 10.

Figure 5:
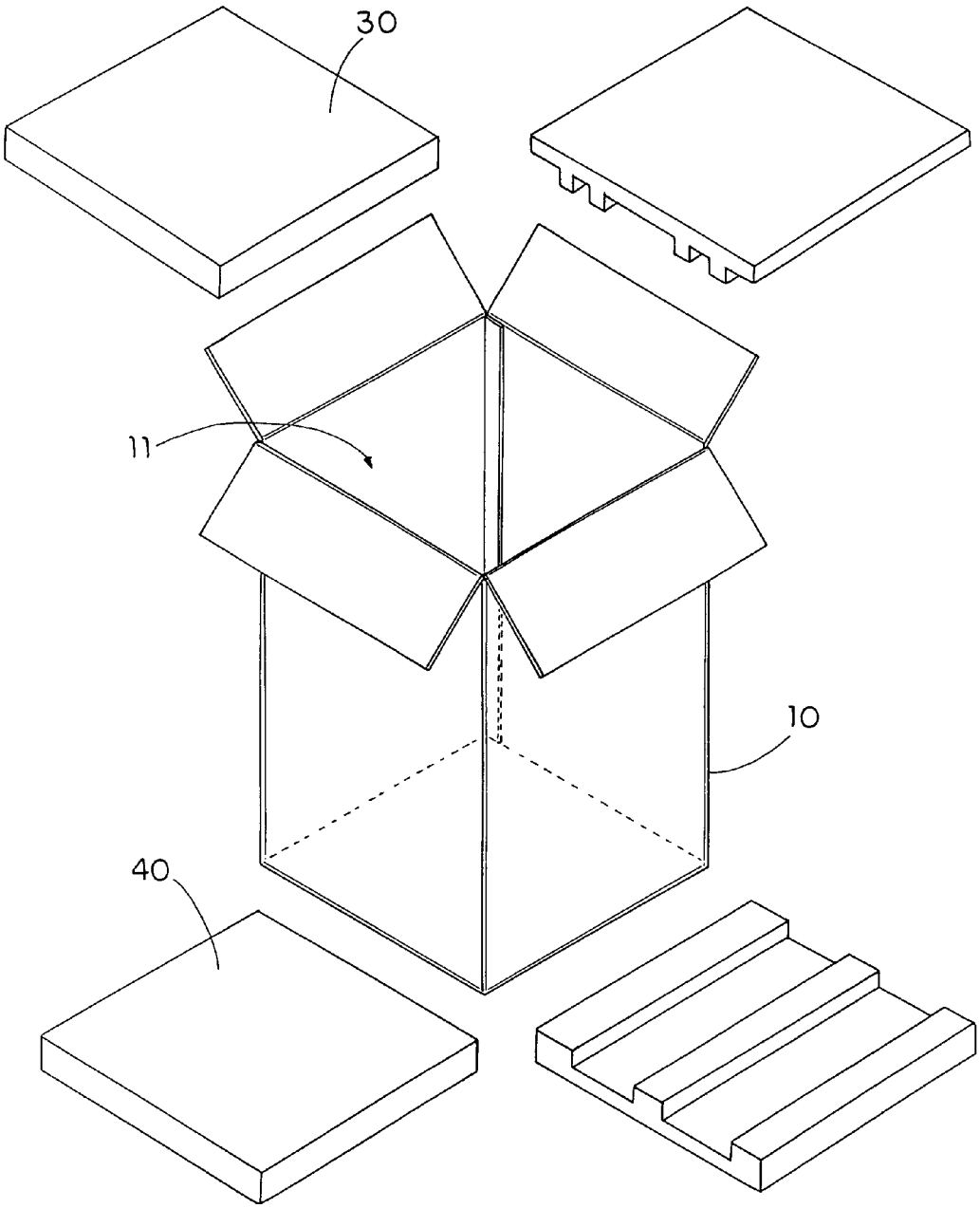
FIG. 5 is a schematic diagram of the package arrangement according to the above preferred embodiment of the present invention, illustrating that the position of the upper cushion and the bottom cushion with respect to the carton.
Figure 6:
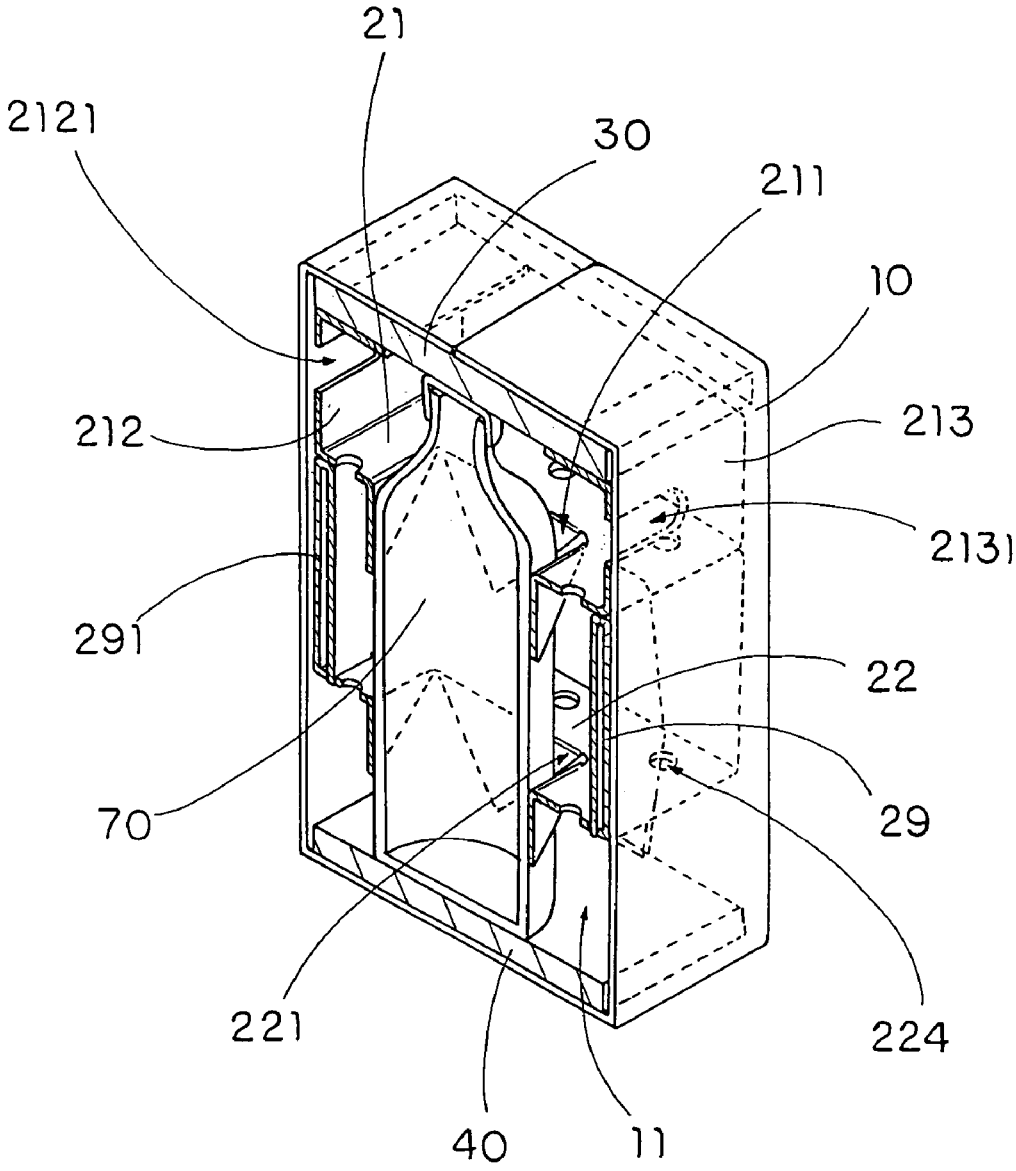
FIG. 6 is a sectional side view of the package arrangement according to the above preferred embodiment of the present invention.
Figure 7A:
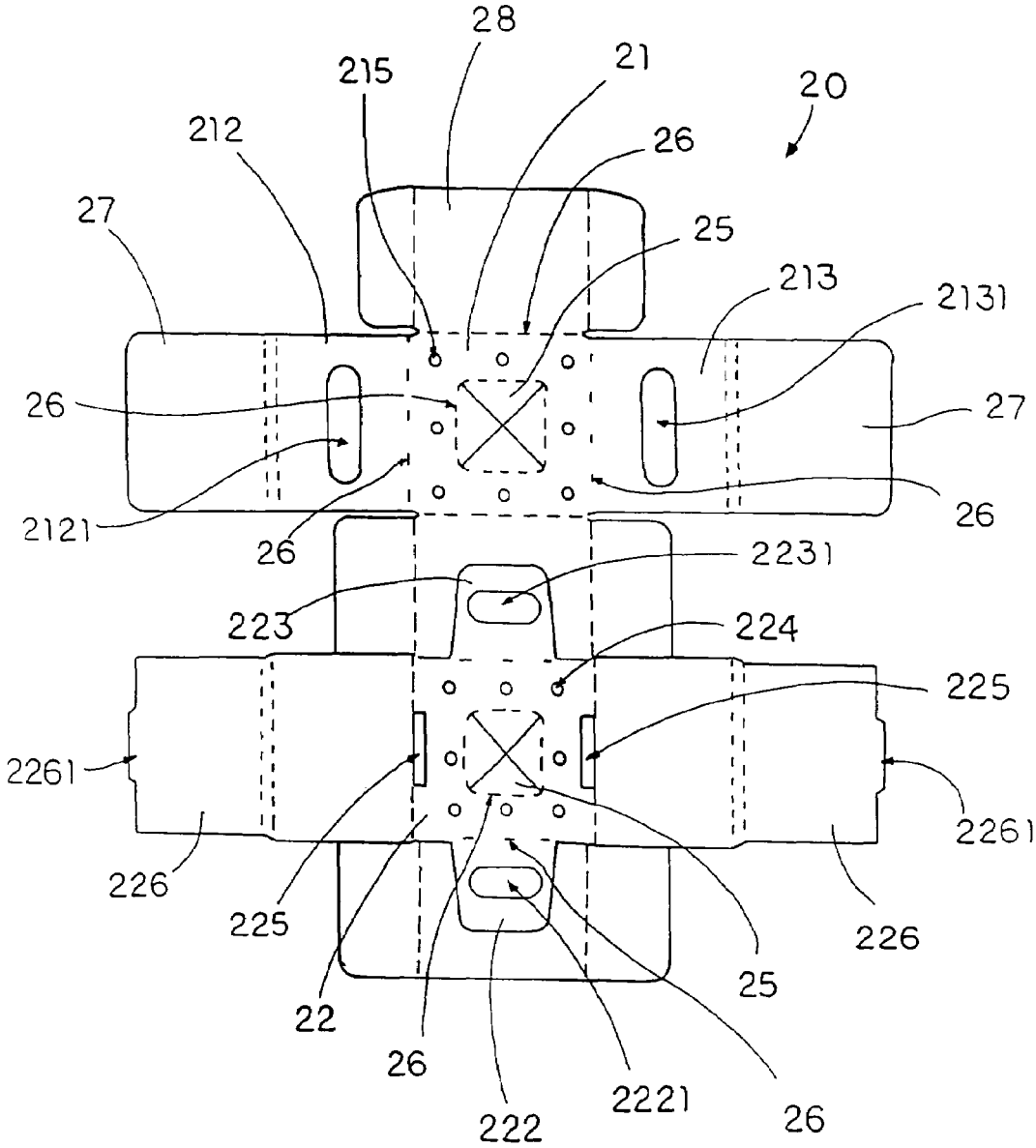
FIGS. 7A and 7B are schematic diagrams of the die cut insert according to the above preferred embodiment of the present invention, illustrating that die cut insert has a single top panel cavity and a single bottom panel cavity, and that the die cut insert has two single top panel cavities and two bottom panel cavities respectively.
Figure 7B:
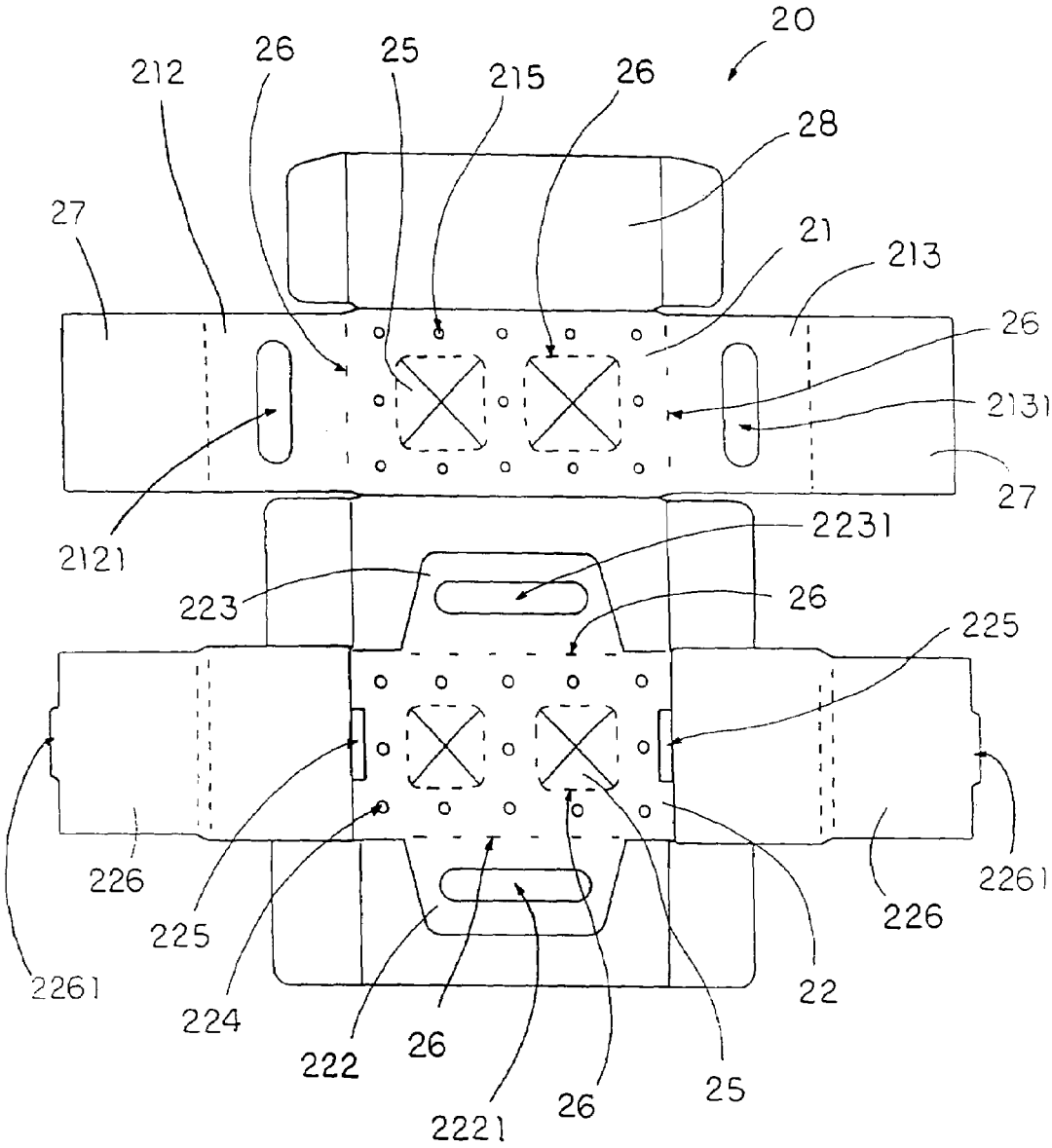
Figure 8A:
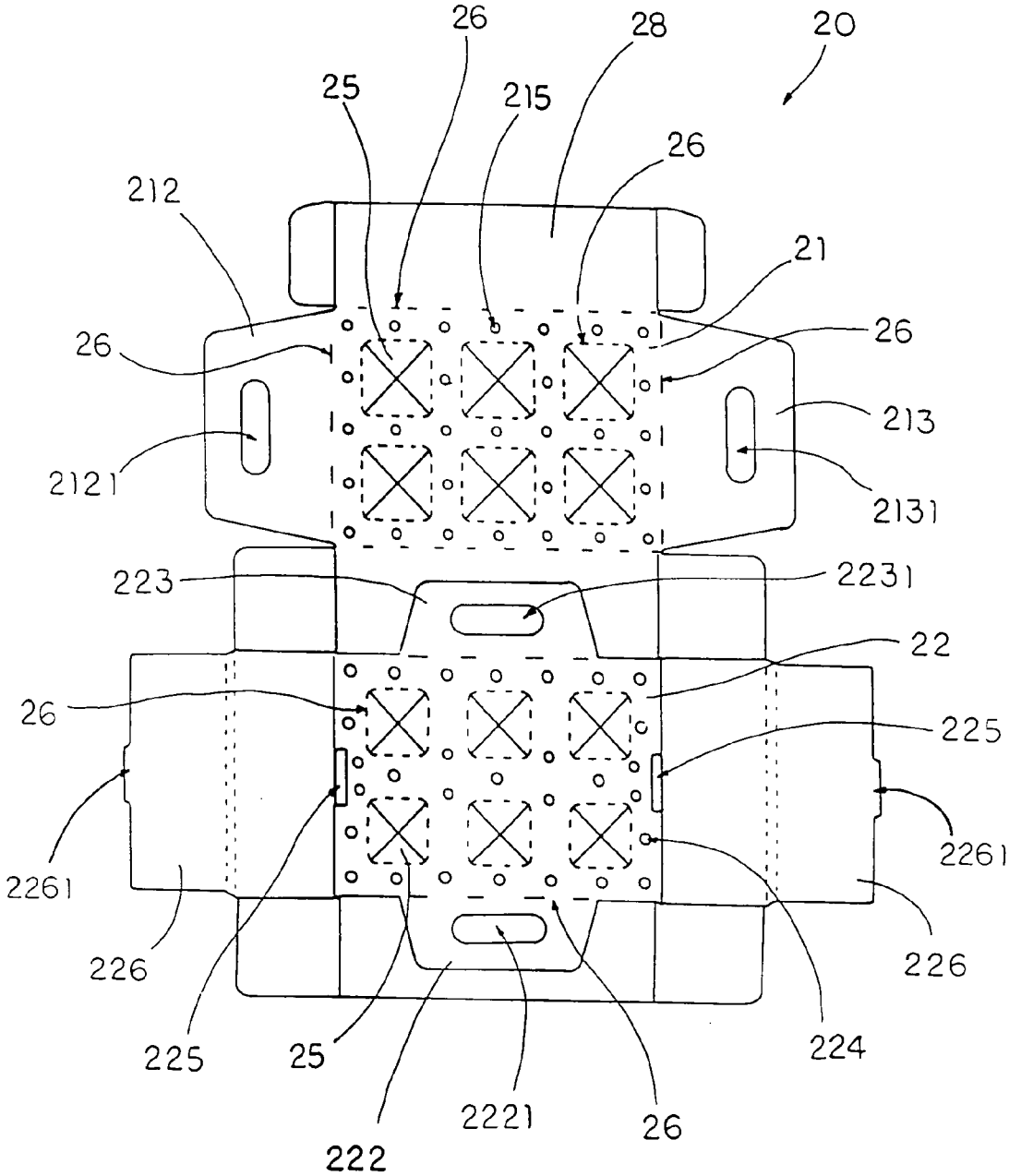
FIGS. 8A and 8B are schematic diagrams of the die cut insert according to the above preferred embodiment of the present invention, illustrating that die cut insert has a single top panel cavity and a single bottom panel cavity, and that the die cut insert has two single top panel cavities and two bottom panel cavities respectively.
Figure 8B:
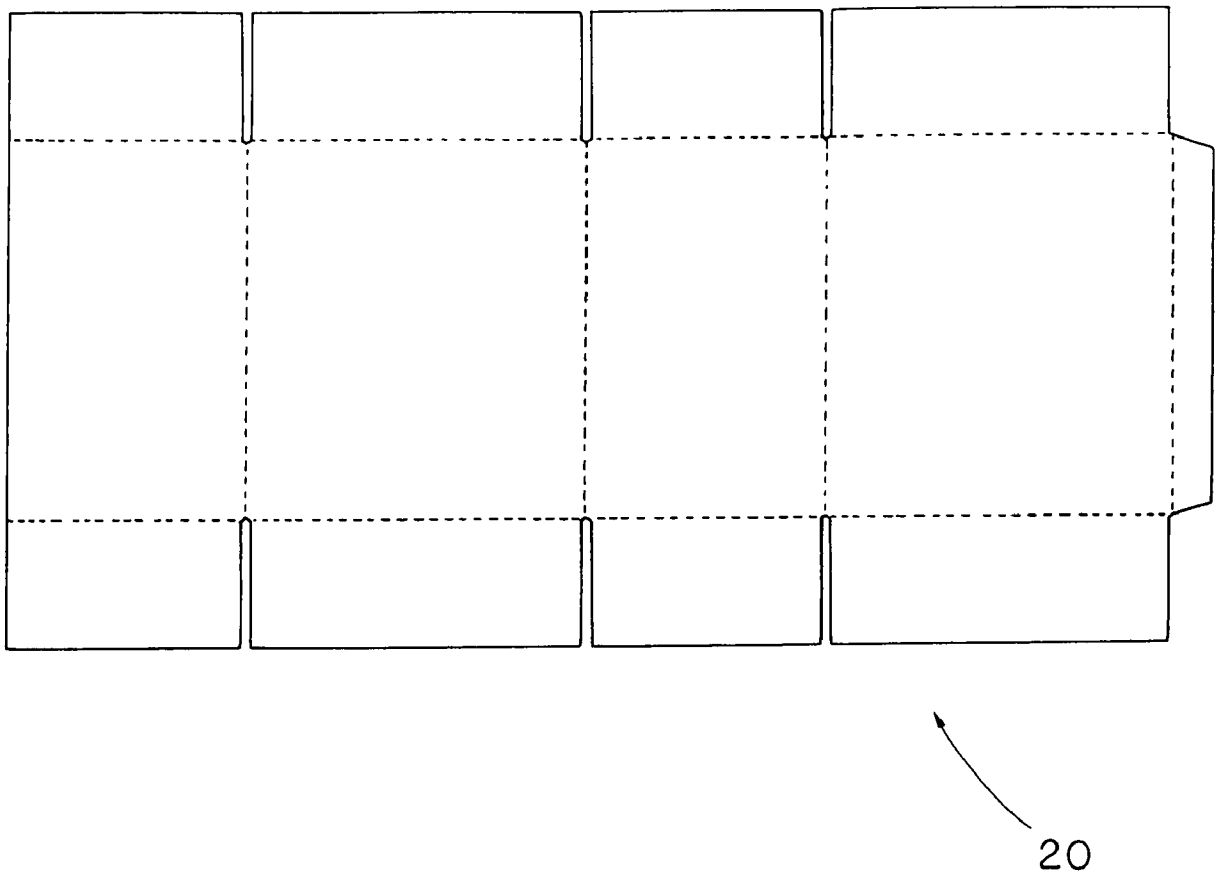

Referring to FIG. 1 and FIG. 5 of the drawings, the package arrangement further comprises an upper cushion 30 and a bottom cushion 40 fittedly and spacedly disposed within the receiving cavity 11 of the carton 10 at a position above and below the die cut insert 20 respectively. Thus, the die cut insert 20 is sandwiched between the upper and bottom cushion 30, 40 for further protecting the container therebetween.

Specifically, each of the top cushion 30 and the bottom cushion 40 is a piece of the flat, U shaped or soft cap parts, preferably made by semi-rigid foam, U-shaped folded fiber board paper board or plastic materials. The top cushion 30 is placed between the top of the container 70 and underneath a top flap of the carton 10 for to absorbing an impact force from an upper portion of the container 70.

On the other hand, the bottom cushion 40 is placed between a bottom of the container 70 and a bottom flap of the carton 10 for absorbing an impact at the lower portion of the container 70 while supporting the container 70 above the bottom cushion 40.

In order to facilitate convenient folding of the various flaps, referring to FIG. 2 and FIG. 3 of the drawings, the die cut insert 20 further comprises a plurality of rib sections 26 formed on the left and right upwards flaps 212, 213, front and the rear downward flaps 222, 223, and the joined flaps 25, wherein each of the rib sections 26 has a plurality of perforated holes spacedly formed thereon to allow convenient folding of the respective flap alone the rib section 26.

Thus, the plurality of rib sections 26 is formed along connecting edges of the left and right upwards flaps 212, 213 and the front and rear downward flaps 222, 223 respectively, wherein the perforated holes are spacedly formed along the connecting edges to allow easy folding of the left and right upwards flaps 212, 213 and the front and rear downward flaps 222, 2232 with respect to the top and bottom panels 22, 23.

Accordingly, each of the rib sections 26 has a plurality of non perforated portions between each two adjacent perforated holes so as to form a connecting line which supports the respective flap to maintain and reinforce its required respective position due to materials memory. In other words, the non perforated portion of the rib section 26 is adapted to retain a predetermined rigidity of the respective rib section 26 so as to retain the respective in a predetermined position until it is folded or unfolded.

Furthermore, the top panel 21 further has a plurality of first slit holes 215 formed thereon, wherein the first slit holes 215 are formed at a position surrounding the top panel cavity 211 for reinforcing the top panel 21 in such a manner to resist unwanted bending thereof. Similarly, the bottom panel 22 further has a plurality of second slit holes 224 formed thereon, wherein the second slit holes 224 are formed at a position surrounding the bottom panel cavity 221 for reinforcing the bottom panel 22. Thus, the first and second slits holes 215, 224 are adapted to reinforce the top and bottom panels 21, 22 to resist an unwanted bending movement thereof.

In addition, the first and the second slit holes 215, 224 provide a predetermined amount of resilient effect to the die cut inset 20 while enhancing a resistance to deformation of the top panel 21 the bottom panel 22, such that the overall effect would be to enhance an overall strength of the die cut insert 20.

Figure 9:
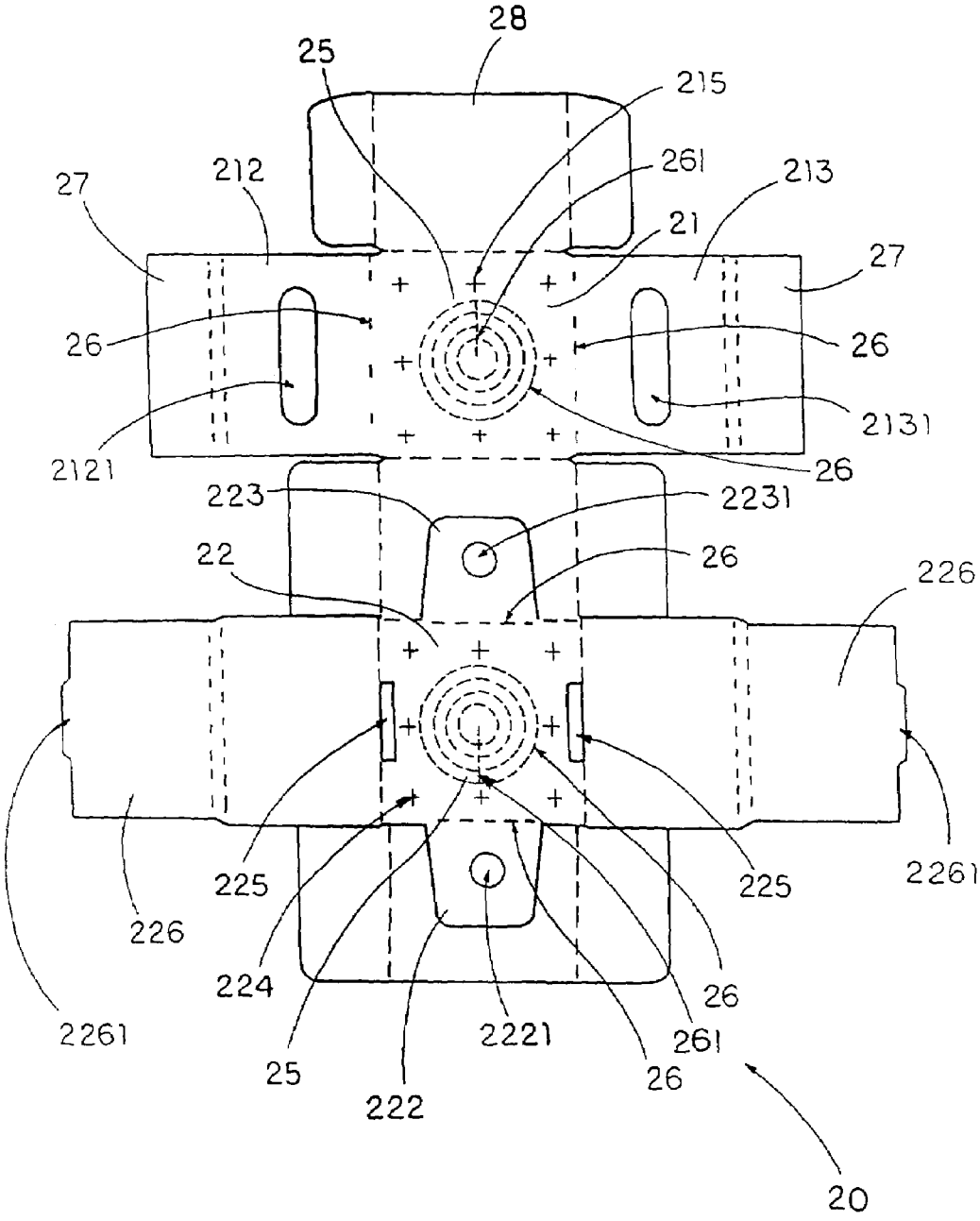
FIG. 9 is an alternative of the rib section according to the above preferred embodiment of the present invention.

Referring to FIG. 9 of the drawings, the rib sections 26 at the joined flaps 25 are embodied as a plurality of cutting rings coaxially provided at the joined flaps 25 wherein the cutting rings are adapted to be cut through along the corresponding connecting line so as to detach the respective joined flap 25 to create the top panel cavity 211 and the bottom panel cavity 221. It is worth mentioning that a user may be able to selectively cut through the cutting rings so as to optimally adjust a size of the top panel cavity 211 and the bottom panel cavity 221 for optimally retaining the container 70 by the die cut insert 20. In such circumstances, a tearing line 261 can be provided radially along the cutting rings so as to facilitate convenient cutting through of the relevant connecting lines. Moreover, as an alternative of the slit holes 224, as shown in FIG. 9 of the drawings, they are embodied as having crafted to be a 'cross' shape hole so as to strengthen the top and the lower panel 21, 22.

Furthermore, it has to be appreciated that when the container is disposed into the top panel cavity 211 and the bottom panel cavity 221 those remaining cutting rings would serve as a cushion for absorbing vibration so as to provide additional cushioning effect to the container which is disposed in the top panel cavity 211 and the bottom panel cavity 221.

Referring to FIG. 1 and FIG. 3 of the drawings, the die cut insert 20 further comprises a left and a right horizontal flaps 27 integrally and outwardly extended from a side edge of the left upward flap 212 and the right upward flap 213 in a foldably movable manner, such that they are capable of being inwardly folded with respective to the left upward flap 212 and the right upward flap 213 to face towards each other so as to support the upper cushion 30 thereon within the receiving cavity 11 of the carton 10. Thus, the left and right flaps 27 are adapted to support at the upper cushion 30 when the die cut insert 20 and the upper cushion 30 are detachably disposed in the receiving cavity 11 for supporting the container 70 within the carton 10.

Referring to FIG. 1 to FIG. 3 of the drawings, in order to further enhance the strength of the die cut insert 20, the die cut insert 20 further comprises a front overlap panel 28 overlappedly formed in front of the front panel 23 for providing a double wall structure at a front side of the die cut insert 20.

Moreover, the bottom panel 22 further has a left and a right inner tray lock in panel hole 225 formed on a right and a left side edge of the bottom panel 22 respectively, wherein two inner tray lock in panels 226, each having an inner tray lock in panel front 2261 and formed at two sides of the die cut insert 20, are folded to engage the inner tray lock in panel front 2261 with the respective inner tray lock in panel holes 225 and sandwich the respective inner trap flaps 227 to form a tri-wall structure on the right and left side of the inner die cut insert 20.

In other words, the fiberboard is folded to form the die cut insert 20 that the front panel 23 has a double wall structure and each of the two side panels 29, 291 has a triple wall structure to enhance a strength of the die cut insert 20.

The bottle/can is usually made by brittle glass, soft tin plastic or metal cans. The bottle may contain alcohol, oil, acids, ink, paint and other flammable liquids or flammable gas.

From the forgoing descriptions, it can be shown that the means for top protecting, guiding and framing protects the bottles upper portion (horizontally) comprises the top panel 21, whereas the means for bottom protecting, guiding and framing comprises the bottom panel 22. Moreover, the means for top positioning spacing and guiding contains top panel cavity 211 and the respective joined flaps 25 extended on the top panel cavity 211, whereas the means for bottom positioning spacing and guiding contains the bottom panel cavity 221 and the respective joined flaps 25 extended on the bottom panel cavity 221.

Moreover, the means for upward standing, supporting and framing comprises the left upward flap 212 and the right upward flap 213, whereas the means for downward standing, supporting and framing comprises front downward flap 222 and the rear downward flap 223.

On the other hand, the means for supporting horizontally comprises the right and the left horizontal flap 27 respectively, whereas the means for balancing the upper side impact comprises the top panel 21 having the slit holes 215 formed surrounding the top panel cavity 211.

The means for absorbing top/bottom impact comprises the upper cushion 30 and the bottom cushion 40 received in the carton 10. As such, the means for absorbing bottom impact was placed between the bottom of the means for holding liquid and the bottom flaps of the means for protecting and enclosing to absorb the impact from the bottles bottom part.

Figure 10:
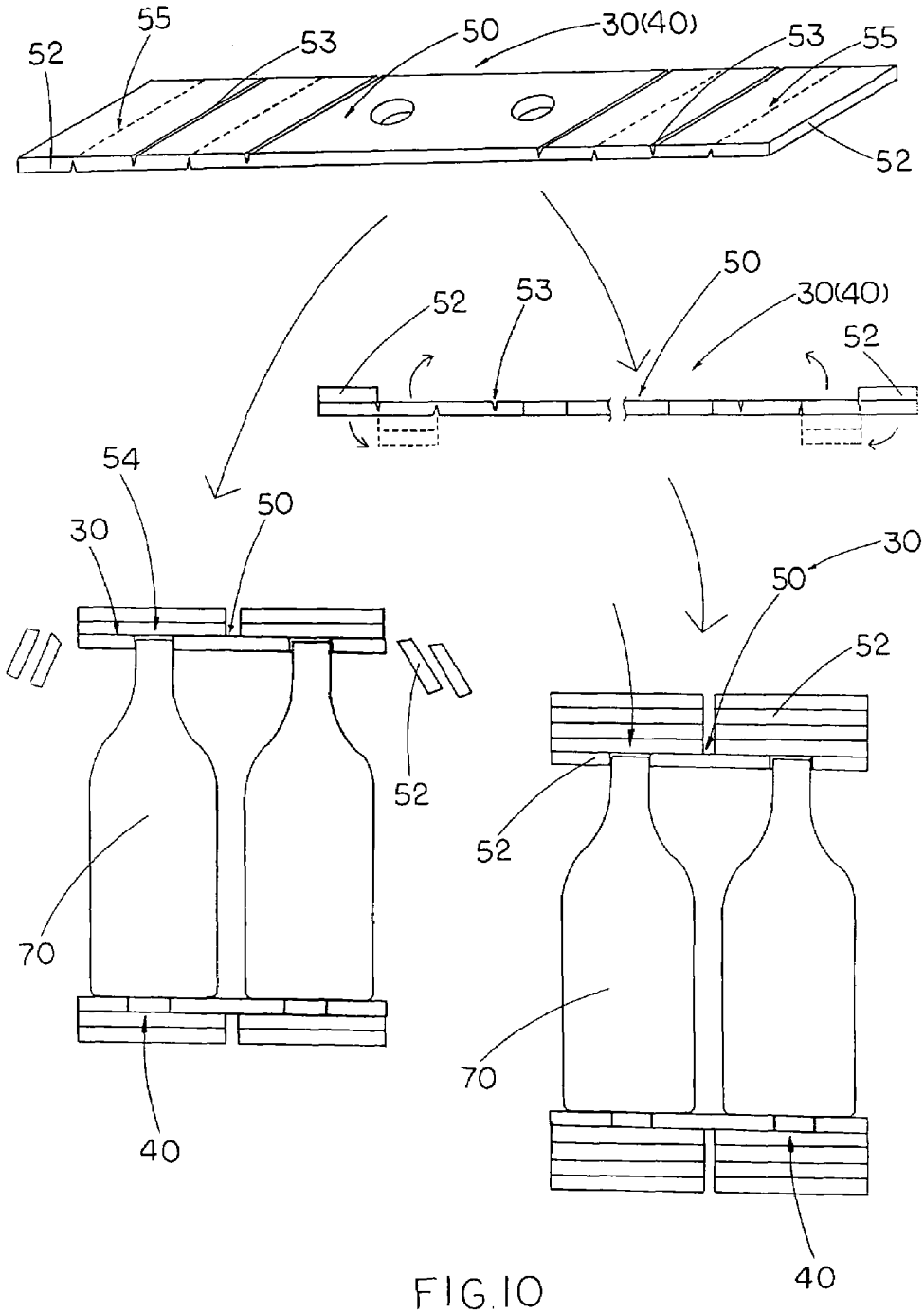
FIG. 10 is a schematic diagram of the upper cushion and the lower cushion according to the above preferred embodiment of the present invention.

Referring to FIG. 10 of the drawings, in order to facilitate convenience utilization of the present invention, the means for absorbing top/bottom impact is embodied as being made of rigid fiberboard which has a main cushion portion 51 and a plurality of edge flips 52 provided on two side edge portions of the fiberboard in a side-by-side manner wherein each of the edge flips 52 is adapted to overlappedly fold with respect to the adjacent edge flip 52 to form the upper cushion 30 or the lower cushion 40, wherein the container 70 is to be securely supported between the upper and lower cushion 30, 40.

Accordingly, the means for absorbing top/bottom impact contains a plurality of folding ribs 53 formed in between each two edge flips 52 for easy allowing folding or trimming of the relevant edge flips 52. Moreover, the means for absorbing top/bottom impact further has a plurality of tearing edges 55 formed between each two folding ribs 53 such that the user is allowed to tear alone the tearing edges 55 into a suitably sized upper or lower cushion 30, 40. Therefore, the upper cushion 30 and the lower cushion 40 can be formed by trimming the edge flips 52 from the main cushion portion 51 of the upper cushion 30 or the lower cushion 40.

Figure 11:
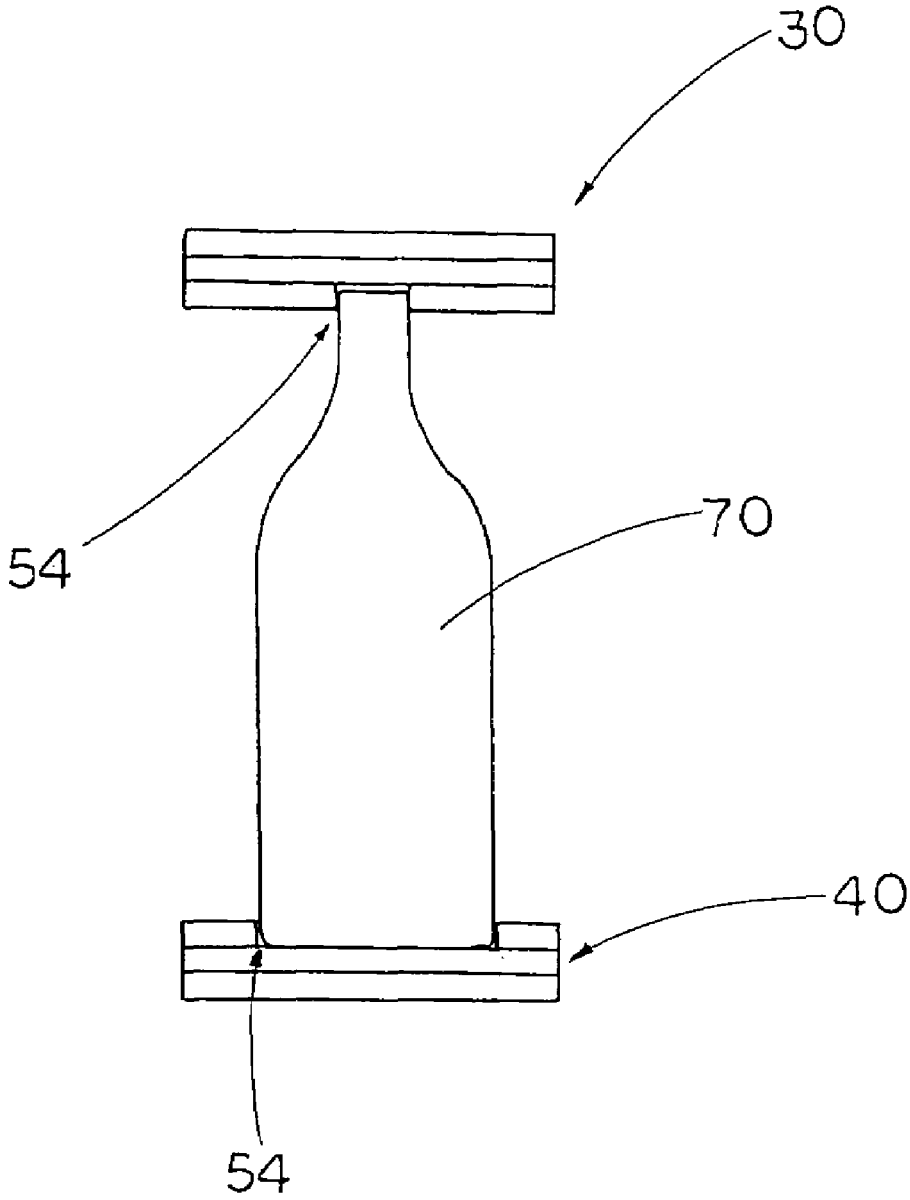
FIG. 11 is a schematic diagram of the upper cushion and the lower cushion according to the above preferred embodiment of the present invention, illustrating that the container is retained within two retaining holes on the upper cushion and the lower cushion respectively.

Referring to FIG. 11 of the drawings, moreover, the means for absorbing top/bottom impact further contains at least a retaining hole 54 formed on the upper cushion 30 and the lower cushion 40 shaped and sized to receive a head portion of the container 70 so as to substantially support the container within the carton 10 when the rigid fiberboard is overlappedly folded in their respective edge flips 52 to form the upper cushion 30 and the lower cushion 40.

Alternatively, the upper cushion 30 and the lower cushion 40 may be formed by trimming the edge flips 52 from the main cushion portion 51 so as to achieve a suitable size for receiving into the carton 10, as shown in FIG. 10 of the drawings.

Obviously, the means for holding liquid comprises the container 70 which is usually made by brittle glass, soft thin plastic or metal cans. The means for holding liquid may contain alcohol, oil, acids, ink, paint, and other flammable liquids or flammable gas.

The means for front reinforcing, holding comprises the front overlap panel 28 forming the double wall structure of the front side of the die cut insert 20.

The means for upper/lower impact balancing surround the means for top positioning, spacing and guiding and means for bottom positioning, spacing and balancing. It can soften the means for upper/bottom cushion holding and to gain the spring effect result.

The rib section 26 of the means for upward standing, supporting and framing, the means for downward standing, supporting and framing, the means for top positioning spacing and guiding, the means for downward standing, supporting and framing, and means for top positioning spacing and guiding, the means for bottom positioning spacing and balancing and the means for supporting horizontally are a non perforated portion of the connecting lines which will support the folding flaps to maintain and reinforce its required holding position because of the material memory.

In other words, owning to materials memory inherent in the fiberboard which forms the die cut insert 20, when the left upward flap and the right upward flap 212, 213 are slightly folded to receive in the receiving cavity 11 of the carton 10, they would automatically unfold to bias against the respective sidewall of the carton 10 so as to fictionally engage with the carton for securing supporting the container 70 within the receiving cavity 11.

It is also worth mentioning at this point that the fiberboard is preferably embodied as forming a flute structure for allowing a predetermined amount of cushioning effect for the fiberboard. Thus, where the fiberboard is utilized to form the upper cushion 30 and the lower cushion 40, the flute structure is adapted to provide additional cushioning effect to the container 70 due to the cushioning effect originated from the flute structure.

Referring to FIG. 7A, FIG. 7B, FIG. 8A and FIG. 8B of the drawings, in operation, the carton 10 with a secured inner die cut insert 20 is to pack glass bottles or cans (container 70). The inner die cut insert 20 was die cut to a specific patterned by a steel rule cutting die board, a flat sheet of corrugated fiber board running through a high speed rotating machine mounted with a steel cutting die board. The inner die cut insert 20 was folded and formed from pattern. The glass bottle/can (container 70) will fit closely into the top panel cavities 211 and the bottom panel cavities 221. The top and bottom panel 21, 22 have a distance in between the cavities 211, 221. The cavities have a space between so that the glass bottles/cans will never shift around. The distances surrounding the bottles/cans form a cushion boundary to avoid the horizontal impact. The upwards 212, 213 and downwards flaps 222, 223 will block the die cut insert 20 and position the top and bottom cushion 30, 40 to form a vertical cushion boundary which will absorb the bottles vertical impact. The squared surface of the inserted walls engage with the square surface of the fiberboard which will not only reinforce the wall strength but will also never allow the inserts to shift around.

In performance testing, six glass bottles filled with olive oil were packed into six cavities of the inner die cut insert, placed with one inch thick EPS as top and bottom cushion 30, 40 and packed into a double wall carton 10. The package was tested according to the International Safe Transit Association Industry standard test procedures (ISTA-1A); ten free fall drops were done on the same package from different directions as required. The test results showed no damages occurred.

Referring to FIG. 7A, FIG. 7B, FIG. 8A and FIG. 8B of the drawings, the top panel 21 and the bottom panel 22 may have more than one top panel cavity 211 and bottom panel cavity 221 so as to contain more than one container 70. Moreover, the top panel cavity 211 can be formed as larger than the bottom panel cavity 221 so as to fit any specific container 70.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A package arrangement for storing a container, comprising:

a carton having a receiving cavity; and a die cut insert, which is detachably disposed in said receiving cavity of said carton, comprising:

a top panel having at least a top panel cavity and a plurality of first slit holes formed at a position surrounding said top panel cavity for providing addition resilient effect to said top panel so as to resist a deformation of said top panel, a bottom panel having at least a bottom panel cavity coaxially aligned with said top panel cavity of said top panel and a plurality of second slit holes formed at a position surrounding said bottom panel cavity for providing addition resilient effect to said bottom panel so as to resist a deformation of said bottom panel, wherein said top and bottom panels are adapted for holding said container in position that an upper portion of said container is encircled within said top panel cavity while a lower portion of said container is encircled within said bottom panel cavity;

a front panel, a rear panel, a right panel, and a left panel to form a box shaped structure, wherein said front, rear, right, and left panels are biased against four inner walls of said carton for absorbing a relative external impact force from said carton to said container;

a left upward flap and a right upward flap foldably extended from a top left side edge and a top right side edge of said top panel respectively to frictionally engage with said two opposed inner walls of said carton respectively when said die cut insert is slidably disposed in said carton for preventing said die cut insert from moving upward within said carton;

a front downward flap and a rear downward flap foldably extended from a bottom front side edge and a rear bottom side edge of said bottom panel to frictionally engage with another said two opposed inner walls of said carton respectively when said die cut insert is slidably disposed in said carton for preventing said die cut insert from moving downward within said carton; and a plurality of joined flaps foldably extended from corresponding surrounding edges of said top panel cavity and said bottom panel cavity to cover said top panel cavity and said bottom panel cavity, wherein said joined flaps are folded downwardly for substantially holding said container when said container is slidably inserted into said top and bottom panel cavities so as to retain said container within said receiving cavity in position.

2. The package arrangement, as recited in claim 1, wherein a piece of fiberboard is folded to form said die cut insert having said top, bottom, front, rear, lefts and right panels, wherein said left and right upward flaps are integrally extended from said top panel and said front and rear downward flaps are integrally extended from said bottom panel for enhancing a reinforced structure of said die cut insert.

3. The package arrangement, as recited in claim 2, wherein said fiberboard is folded to form said die cut insert that said front panel has a double wall structure and each of said left and right panels has a triple wall structure to enhance a strength of said die cut insert.

4. The package arrangement, as recited in claim 1, wherein said die cut insert further has a plurality of rib sections formed at said joined flaps to form a plurality of cutting rings coaxially provided at said joined flaps and a plurality of tearing lines radially provided along said cutting rings such that said top and bottom panels are adapted for self-adjustably retaining said upper and lower portions of said container within said top and bottom panel cavities respectively.

5. The package arrangement, as recited in claim 2, wherein said die cut insert further has a plurality of rib sections formed at said joined flaps to form a plurality of cutting rings coaxially provided at said joined flaps and a plurality of tearing lines radially provided along said cutting rings such that said top and bottom panels are adapted for self-adjustably retaining said upper and lower portions of said container within said top and bottom panel cavities respectively.

6. The package arrangement, as recited in claim 3, wherein said die cut insert further has a plurality of rib sections formed at said joined flaps to form a plurality of cutting rings coaxially provided at said joined flaps and a plurality of tearing lines radially provided along said cutting rings such that said top and bottom panels are adapted for self-adjustably retaining said upper and lower portions of said container within said top and bottom panel cavities respectively.

7. The package arrangement, as recited in claim 1, wherein said die cut insert further comprises two horizontal flaps integrally and foldably extended from side edges of said left and right upward flaps respectively, wherein said two horizontal flaps are inwardly folded with respect to said left and right upward flaps to adjust a height of said die cut insert.

8. The package arrangement, as recited in claim 3, wherein said die cut insert further comprises two horizontal flaps integrally and foldably extended from side edges of said left and right upward flaps respectively, wherein said two horizontal flaps are inwardly folded with respect to said left and right upward flaps to adjust a height of said die cut insert.

9. The package arrangement, as recited in claim 6, wherein said die cut insert further comprises two horizontal flaps integrally and foldably extended from side edges of said left and right upward flaps respectively, wherein said two horizontal flaps are inwardly folded with respect to said left and right upward flaps to adjust a height of said die cut insert.

10. The package arrangement, as recited in claim 1, wherein each of said left and right upward flaps has a hand hole formed thereon as an upper die cut handle, such that said two upper die cut handles allow said die cut insert to be easily pulled up from said receiving cavity of said carton for lifting up said container.

11. The package arrangement, as recited in claim 3, wherein each of said left and right upward flaps has a hand hole formed thereon as an upper die cut handle, such that said two upper die cut handles allow said die cut insert to be easily pulled up from said receiving cavity of said carton for lifting up said container.

12. The package arrangement, as recited in claim 6, wherein each of said left and right upward flaps has a hand hole formed thereon as an upper die cut handle, such that said two upper die cut handles allow said die cut insert to be easily pulled up from said receiving cavity of said carton for lifting up said container.

13. The package arrangement, as recited in claim 9, wherein each of said left and right upward flaps has a hand hole formed thereon as an upper die cut handle, such that said two upper die cut handles allow said die cut insert to be easily pulled up from said receiving cavity of said carton for lifting up said container.

14. The package arrangement, as recited in claim 1, wherein each of said front and rear downward flaps has a hinge hole formed thereon as a lower die cut handle, such that said two lower die cut handle allow said die cut insert to be slidably adjusted within said receiving cavity of said carton.

15. The package arrangement, as recited in claim 6, wherein each of said front and rear downward flaps has a hinge hole formed thereon as a lower die cut handle, such that said two lower die cut handle allow said die cut insert to be slidably adjusted within said receiving cavity of said carton.

16. The package arrangement, as recited in claim 9, wherein each of said front and rear downward flaps has a hinge hole formed thereon as a lower die cut handle, such that said two lower die cut handle allow said die cut insert to be slidably adjusted within said receiving cavity of said carton.

17. The package arrangement, as recited in claim 13, wherein each of said front and rear downward flaps has a hinge hole formed thereon as a lower die cut handle, such that said two lower die cut handle allow said die cut insert to be slidably adjusted within said receiving cavity of said carton.

18. A die cut insert for disposing into a carton to retain a container in position, wherein said die cut insert, which is formed by a piece of fiberboard having predetermined shape folded to form a box shaped structure, comprises:

a top panel having at least a top panel cavity and a plurality of first slit holes formed at a position surrounding said top panel cavity for providing addition resilient effect to said top panel so as to resist a deformation of said top panel, a bottom panel having at least a bottom panel cavity coaxially aligned with said top panel cavity of said top panel and a plurality of second slit holes formed at a position surrounding said bottom panel cavity for providing addition resilient effect to said bottom panel so as to resist a deformation of said bottom panel, wherein said top and bottom panels are adapted for holding said container in position that an upper portion of said container is encircled within said top panel cavity while a lower portion of said container is encircled within said bottom panel cavity;

a front panel, a rear panel, a right panel, and a left panel to form a box shaped structure, wherein said front, rear, right, and left panels are arranged for biasing against four inner walls of said carton for absorbing a relative external impact force from said carton to said container;

a left upward flap and a right upward flap foldably extended from a top left side edge and a top right side edge of said top panel respectively for frictionally engaging with said two opposed inner walls of said carton respectively when said die cut insert is slidably disposed in said carton for preventing said die cut insert from moving upward within said carton;

a front downward flap and a rear downward flap foldably extended from a bottom front side edge and a rear bottom side edge of said bottom panel for frictionally engaging with another said two opposed inner walls of said carton respectively when said die cut insert is slidably disposed in said carton for preventing said die cut insert from moving downward within said carton; and a plurality of joined flaps foldably extended from corresponding surrounding edges of said top panel cavity and said bottom panel cavity to cover said top panel cavity and said bottom panel cavity, wherein said joined flaps are folded downwardly for substantially holding said container when said container is slidably inserted into said top and bottom panel cavities so as to retain said container within said receiving cavity in position.

19. The die cut insert, as recited in claim 18, wherein said fiberboard is folded to form said die cut insert that said front panel has a double wall structure and each of said left and right panels has a triple wall structure to enhance a strength of said die cut insert.

20. The die cut insert, as recited in claim 18, further having a plurality of rib sections formed at said joined flaps to form a plurality of cutting rings coaxially provided at said joined flaps and a plurality of tearing lines radially provided along said cutting rings such that said top and bottom panels are adapted for self-adjustably retaining said upper and lower portions of said container within said top and bottom panel cavities respectively.

21. The die cut insert, as recited in claim 19, further having a plurality of rib sections formed at said joined flaps to form a plurality of cutting rings coaxially provided at said joined flaps and a plurality of tearing lines radially provided along said cutting rings such that said top and bottom panels are adapted for self-adjustably retaining said upper and lower portions of said container within said top and bottom panel cavities respectively.

22. The die cut insert, as recited in claim 18, further comprising two horizontal flaps integrally and foldably extended from side edges of said left and right upward flaps respectively, wherein said two horizontal flaps are inwardly folded with respect to said left and right upward flaps to adjust a height of said die cut insert.

23. The die cut insert, as recited in claim 19, further comprising two horizontal flaps integrally and foldably extended from side edges of said left and right upward flaps respectively, wherein said two horizontal flaps are inwardly folded with respect to said left and right upward flaps to adjust a height of said die cut insert.

24. The die cut insert, as recited in claim 21, further comprising two horizontal flaps integrally and foldably extended from side edges of said left and right upward flaps respectively, wherein said two horizontal flaps are inwardly folded with respect to said left and right upward flaps to adjust a height of said die cut insert.

25. The die cut insert, as recited in claim 18, wherein each of said left and right upward flaps has a hand hole formed thereon as an upper die cut handle, such that said two upper die cut handles allow said die cut insert to be easily pulled up from said receiving cavity of said carton for lifting up said container.

26. The die cut insert, as recited in claim 19, wherein each of said left and right upward flaps has a hand hole formed thereon as an upper die cut handle, such that said two upper die cut handles allow said die cut insert to be easily pulled up from said receiving cavity of said carton for lifting up said container.

27. The die cut insert, as recited in claim 21, wherein each of said left and right upward flaps has a hand hole formed thereon as an upper die cut handle, such that said two upper die cut handles allow said die cut insert to be easily pulled up from said receiving cavity of said carton for lifting up said container.

28. The die cut insert, as recited in claim 24, wherein each of said left and right upward flaps has a hand hole formed thereon as an upper die cut handle, such that said two upper die cut handles allow said die cut insert to be easily pulled up from said receiving cavity of said carton for lifting up said container.

29. The die cut insert, as recited in claim 18, wherein each of said front and rear downward flaps has a hinge hole formed thereon as a lower die cut handle, such that said two lower die cut handle allow said die cut insert to be slidably adjusted within said receiving cavity of said carton.

30. The die cut insert, as recited in claim 21, wherein each of said front and rear downward flaps has a hinge hole formed thereon as a lower die cut handle, such that said two lower die cut handle allow said die cut insert to be slidably adjusted within said receiving cavity of said carton.

31. The die cut insert, as recited in claim 24, wherein each of said front and rear downward flaps has a hinge hole formed thereon as a lower die cut handle, such that said two lower die cut handle allow said die cut insert to be slidably adjusted within said receiving cavity of said carton.

32. The die cut insert, as recited in claim 28, wherein each of said front and rear downward flaps has a hinge hole formed thereon as a lower die cut handle, such that said two lower die cut handle allow said die cut insert to be slidably adjusted within said receiving cavity of said carton.

* * * * *